US005191936A

United States Patent [19]

Edwards et al.

[11] Patent Number: 5,191,936

[45] Date of Patent: Mar. 9, 1993

[54] METHOD AND APPARATUS FOR CONTROLLING A WELL TOOL SUSPENDED BY A CABLE IN A WELLBORE BY SELECTIVE AXIAL MOVEMENTS OF THE CABLE

[75] Inventors: A. Glen Edwards, Hockley; Klaus B. Huber, Sugar Land; Antoni K. L. Miszewski, Missouri City, all of Tex.

[73] Assignee: Schlumberger Technology Corporation, Houston, Tex.

[21] Appl. No.: 684,083

[22] Filed: Apr. 10, 1991

[51] Int. Cl.[5] ..... E21B 43/116

[52] U.S. Cl. ..... 166/297; 166/55.1; 175/4.52; 175/4.56

[58] Field of Search ..... 166/297, 55.1, 382, 166/385, 209, 217, 237; 175/4.52, 4.54, 4.56

[56] References Cited

U.S. PATENT DOCUMENTS

| | | | |
|---|---|---|---|
| 1,260,036 | 3/1918 | Perry | 166/209 |
| 3,183,972 | 5/1965 | Fredd | 175/4.52 |
| 3,366,179 | 1/1968 | Kinley et al. | 175/4.56 X |
| 3,375,785 | 4/1968 | Moore | 102/20 |
| 3,661,205 | 5/1972 | Belorgey | 166/65 R |
| 3,664,416 | 5/1972 | Nicholas et al. | 166/65 |
| 4,042,019 | 8/1977 | Henning | 166/209 X |
| 4,125,013 | 11/1978 | Nicholas et al. | 73/151 |
| 4,306,628 | 12/1981 | Adams, Jr. et al. | 175/4.56 |
| 4,509,604 | 4/1985 | Upchurch | 175/4.52 |
| 4,554,975 | 11/1985 | Vann et al. | 166/297 |
| 4,574,892 | 3/1986 | Grigar et al. | 166/297 X |
| 4,610,312 | 9/1986 | Nelson et al. | 175/4.52 |
| 4,611,660 | 9/1986 | Stout et al. | 166/297 |
| 4,678,035 | 7/1987 | Goldschild | 166/332 X |
| 4,693,308 | 9/1987 | Luke et al. | 166/55.1 |
| 4,806,928 | 2/1989 | Veneruso | 340/856 |
| 5,044,437 | 9/1991 | Wittrisch | 166/55.1 X |
| 5,054,555 | 10/1991 | Lalande et al. | 166/55.1 X |

*Primary Examiner*—Hoang C. Dang

*Attorney, Agent, or Firm*—Henry N. Garrana; John H. Bouchard

[57] ABSTRACT

In the representative embodiment of the method and apparatus of the invention which are disclosed herein, a well tool arranged for suspension in a well bore from a cable includes a mandrel that is telescopically arranged on the tool body and is operable after the tool is stationed in a well bore to be shifted upwardly and downwardly by the cable. A pressure-responsive actuator is arranged on the tool for being released in response to an initial downward movement of the suspension cable for rapidly extending an anchor on the tool body into engagement with the well casing. Thereafter, a successive upward movement of the suspension cable is effective for releasing the pressure-responsive actuator for slowly traveling to a position in the tool body where a firing pin on the body is released for detonating an impact-actuated explosive device on the tool only after a predetermined time delay following the upward cable movement. Subsequent cable movements are operative for thereafter disengaging the anchor to enable the tool to be recovered from a well bore wall.

25 Claims, 5 Drawing Sheets

METHOD AND APPARATUS FOR CONTROLLING A WELL TOOL SUSPENDED BY A CABLE IN A WELLBORE BY SELECTIVE AXIAL MOVEMENTS OF THE CABLE

BACKGROUND OF THE INVENTION

A great number of well bore operations are conducted by well tools which are dependently coupled to a so-called "wireline" or suspension cable that is spooled on a winch at the surface which is selectively operated for transporting one or more so-called "wireline tools" between the surface and various depth locations in a well bore. Electrical conductors are provided in the cable for carrying control and measurement signals between associated surface equipment and the wireline tools as well as transmitting electrical power to electrically-actuated devices on the tools as required for effecting their particular functions.

It will, of course, be recognized that electrically-actuated explosive devices are commonly utilized with wireline tools such as perforating guns, explosive backoff tools as well as chemical and explosive cutting tools. Typically, an electrically-actuated detonating system is selectively operated for supplying power to detonate the explosive devices on the wireline tool once it has been positioned in a well bore. These detonating systems are usually comprised of an encapsulated electrically-responsive detonator that has a sensitive primary explosive cooperatively arranged for setting off a secondary explosive which, in turn, detonates the more-powerful explosive devices on the tool. For example, a typical wireline perforator utilizes an electrically-initiated detonator for setting off an explosive device such as a booster charge or a detonating cord operatively coupled between the detonator and one or more shaped explosive charges carried by the perforator. Explosive pipe-cutting tools commonly use an electrical detonator and a detonating cord for initiating the operation of an annular shaped explosive charge to produce an omnidirectional planar cutting jet for severing a pipe string. Similarly, an explosive backoff tool employs a bundled detonating cord which is actuated by an electrically-responsive detonator. The typical wireline chemical cutter employs an electrically-responsive detonator that ingnites a gas-producing propellant composition that functions to discharge pressured jets of halogen fluoride chemicals against an adjacent well bore surface.

Those skilled in the art clearly appreciate that inadvertent actuation of the electrically-responsive explosive devices on a wireline tool while the tool is located at the surface may result in fatalities and injuries to personnel as well as serious damage to the nearby equipment. One of the most common sources for the premature actuation of a wireline tool utilizing an electric detonator is, of course, the careless connection of an electrical power source to the cable conductors after the well tool has been connected to the suspension cable and the tool is still at the surface. To at least mimimize these risks, the usual practice is to delay the installation of a detonator into the tool as well as the connection of its electrical leads to the cable conductors as long as is reasonably possible. Added protection is provided by controlling the surface power source with a key-operated switch which is not unlocked until the tool is situated at a safe depth in the well bore. In some cases, a pressure-sensitive arming switch is arranged in the downhole firing circuit of a perforator which will not be closed to disable the perforator until it has reached a selected depth.

These various safety devices and procedures will, of course, greatly reduce the chances that the explosive devices carried by these wireline tools will be inadvertently detonated while they are at the surface. Nevertheless, the electrically-initiated detonators commonly used in these well tools are susceptible to being inadvertently detonated by strong electromagnetic fields which may be picked up by the conductors in the suspension cable. For example, premature actuation of a detonator may be caused by lightning for by the unpredictable presence of so-called "stray voltage" which may sporadically appear at various locations in the structure of the drilling platform. These hazards will also be present when a wireline tool having an unfired detonator and one or more unexpended explosive devices is removed from the well bore. This latter situation itself presents and additional hazard since it is not always possible to know whether or not a wireline tool that is being returned to the surface is carrying unexpended electric detonators or explosive devices.

Because of these potential hazards that exist once a tool is armed, many proposals have been made heretofore for appropriate safeguards and precautions for handling these tools while they are at the surface. For instance, when a wireline tool with an electric detonator is being prepared for lowering into a well, in keeping with the susceptibility of electric detonators to strong electromagnetic fields it usually necessary to maintain strict radio and radar silence in the vicinity. Ordinarily a temporary restriction on nearby radio transmissions will not represent a significant problem on a lang rig. On the other hand, whenever service tools with explosives are being used on a drilling vessel or an offshore platform, it is common practice to restrict, if not prohibit, the radio and radar transmissions from the platform as well as from helicopters and surface vessels in the vicinity. Similarly, it may be advisable to postpone any electrical welding operations on the rig or platform since welding machines develop erratic currents in the structure that may inadvertently initiate a sensitive electrical detonator in an unprotected wireline tool at the surface. These delays will have obvious restrictive and costly effects on the operations on many of the other platforms and drilling vessels in the vicinity.

Those skilled in the art will appreciate, of course, that many of these hazards are avoided by employing tubing-conveyed or so-called "TCP" perforating tools that do not require sensitive electrical detonators. These perforators are comprised of an upper body or so-called "firing head" with an impact-actuated detonator and a depending lower body carrying shaped explosive charges. Typical TCP perforators are fully described in, for example, U.S. Pat. No. 4,509,604, U.S. Pat. No. 4,610,312 or U.S. Pat. No. 4,611,660. These perforators are utilized by dependently coupling the perforator to a tubing joint and the lowering the perforator to a selected depth location in a well bore as the supporting tubing string is progressively assembled. In some cases, the perforator is seated on a packer assembly which has been previously set in the well bore for isolating the well bore interval that is to be perforated. The packer assembly is arranged so that once the upper body of the perforator has landed on the packer, the lower body of the tool will be situated below the packer for positioning the shaped charges as necessary for perforating the isolated interval. In other situations, the tubing string is progressively assembled until the perforator is positioned in the selected well bore interval. In either case, once the perforator is positioned at a selected depth location in the well bore, the perforator is selectively initiated from the surface either by dropping a so-called "drop bar" through the tubing string for striking the impact-responsive detonator in the firing head or by varying the pressures inside of the tubing string and in the well bore until a predetermined pressure level or differential is attained for actuating the detonator and setting off the shaped charges in the perforator.

It must be realized, however, that although TCP perforators are relatively unaffected by many of the hazards associated with electrical detonators, measurements representative of various well bore conditions can not be conveniently monitored at the surface. Accordingly, to obtain these measurements as well as to control the firing of the TCP perforator without compromising on safety, a unique transformer coupling system arranged in keeping with the principles of U.S. Pat. No. 4,806,928 (which is hereby incorporated herein by reference) has been effectively employed for inductively coupling a typical wireline cable to a TCP perforator after the perforator has been installed in the well bore. As described in more detail in that patent, this unique coupling system facilitates the transmission of electric power as well as data and/or control signals between the surface equipment and the perforator. Nevertheless, despite the several obvious advantages of that unique coupling system, it has been found that the anchoring device disclosed in that patent may be inadequate to withstand the extreme upward forces that might be produced by exceptionally-high flow rates or the detonation of a great number of powerful explosive charges on the TCP perforator.

OBJECTS OF THE INVENTION

Accordingly, it is an object of the present invention to provide new and improved methods and apparatus for selectively initiating the operation of various well tools from the surface including those well tools with one or more expolsive devices.

It is an additional object of the invention to provide new and improved tool-anchoring systems that are selectively operated by predetermined motions of a cable supporting a wireline tool but which can not be accidentally released by inadvertent cable motions.

It is yet another object of the present invention to provide a new and improved system for reliably actuating wireline tools from the surface by selectively manipulating the suspension cable carrying the wireline tool for anchoring the tool at a selected depth location in a well bore to withstand extreme forces tending to dislodge the tool from that selected location in the well bore and then manipulating the cable for selectively operating one or more explosive devices on the wireline tool without transmitting electrical power or signals through the suspension cable.

SUMMARY OF THE INVENTION

In one manner of attaining these and other objects of the invention, a wireline tool is operatively arranged to include a mandrel which is selectively movable for an initial running-in position to predetermined operating positions in response to successive upward and downward movements of the suspension cable which is supporting the tool in a well bore. In response to the first of these successive cable movements, the wireline tool is releasably anchored at a selected depth location in the well bore by extending anchoring members on the tool into engagement with an adjacent well bore wall. Thereafter, a second movement of the suspension cable is operable for releasing an actuating member which is cooperatively arranged on the tool body for movement into a selected operating position.

Where, for example, the wireline tool is to be utilized for actuating explosives on a well tool which has been previously installed in the well bore, the wireline tool of the present invention carries an impact-actuated detonator that is effective for initiating the detonation of the explosive device carried on the previously-installed well tool. Once the wireline tool is moved into operating proximity of the previously-installed well tool, the suspension cable is selectively manipulated for moving the tool anchors into engagement with the well bore wall. Then, when the explosive devices on the previously-installed well tool are to be initiated, the suspension cable is again manipulated for releasing an actuating member which is operable for striking the impact-actuated detonator carried by the wireline tool with sufficient force for setting off the explosive devices that are on the previously-installed well tool after a predetermined time delay.

In practicing the methods of the invention, an explosively-actuated well tool is installed in a well bore and a wireline tool arranged in accordance with the principles of the invention is then moved into the well bore adjacent to the previously-installed well tool for positioning an impact-actuated detonator on the wireline tool into detonating proximity of an explosive detonator on the well tool. The suspension cable supporting the wireline tool is then selectively manipulated at the surface for rapidly extending tool-anchoring members on the wireline tool to secure the wireline tool at a selected depth location in the well bore. Thereafter, the suspension cable is again selectively moved at the surface for driving a detonating member on the wireline tool into the impact-actuated detonator for initiating the detonation of the explosive devices carried on the previously-installed well wool after a predetermined interval of time. Once the explosive devices are detonated, the suspension cable is then selectively manipulated for retracting the tool-anchoring members and returning the wireline tool to the surface.

BRIEF DESCRIPTION OF THE DRAWINGS

The novel features of the present invention are set forth with particularity in the appended claims. The invention along with still other objects and additional advantages thereof may be best understood by way of exemplary methods and apparatus which employ the principles of the invention as best illustrated in the accompanying drawings in which:

DESCRIPTION OF A PREFERRED EMBODIMENT OF THE INVENTION

Figure 1:
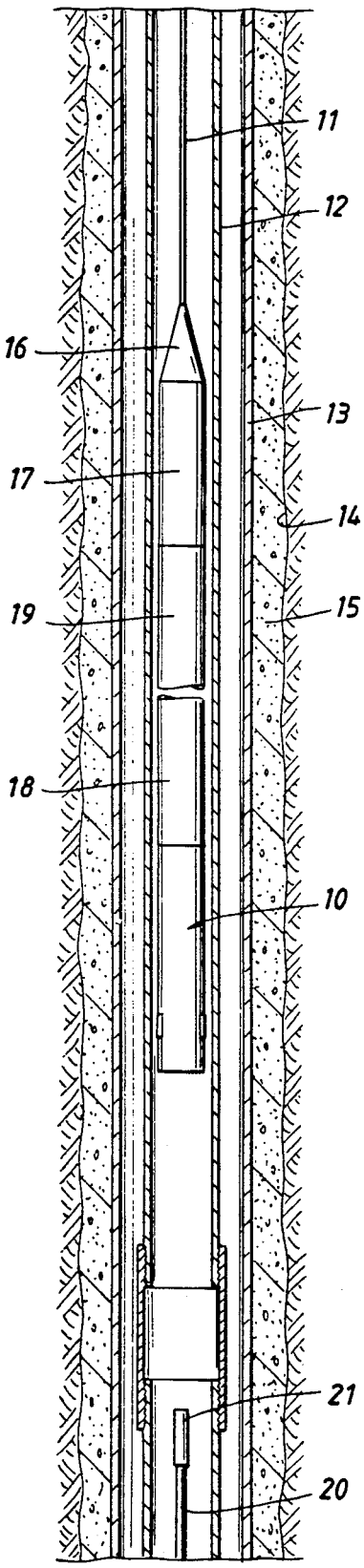
FIG. 1 schematically depicts a new and improved wireline tool which includes selectively-operated tool-actuating and tool-anchoring systems arranged in accordance with the principles of the present invention.

Turning now to FIG. 1, a new and improved wireline tool 10 including selectively-operated tool-anchoring and tool-actuating system arranged in accordance with the principles of the present invention is shown with this tool connected to the lower end of a suspension cable such as a wireline cable 11 having a plurality of electrical conductors. As a typical, the cable 11 is spooled on a winch (not illustrated in the drawings) positioned at the surface for being selectively operated as needed for moving the tool 10 through a tubing string 12 which is suspended within a string of casing 13 that is secured within a borehole 14 by a column of cement 15. The wireline tool 10 is dependently coupled to the lower end of the suspension cable 11 by a rope socket or cable head 16 which facilitates the connection of the cables conductors to the tool. The tool 10 further includes a collar locator 17 that is connected by way of the conductors in the cable 11 to surface instrumentation (not depicted) to provide characteristic signals representative of the depth location of the tool as it is successively moved past the several collars in the tubing string 12. The tool 10 may also include a typical measuring instrument such as a pressure recorder 18 to provide real-time measurements of selected well bore conditions during the utilization of the wireline tool for selectively controlling another well tool stationed at a lower depth interval in the borehole 14 below the field of view of FIG. 1.

The tool 10 is shown as carrying a male inductive coupler 19 (such as is described in the aforementioned U.S Pat. No. 4,806,928) that is specially arranged on the wireline tool to cooperate with a matching female coupler (not illustrated in the drawings) which would be located in the tubing string 12 at the correct distance above housing 21 or in the body of another well tool such as a TCP perforator (not illustrated) which was previously positioned at a selected depth location in the borehole 14. Nevertheless, it must be understood that the present invention is wholly outside of the scope of U.S. Pat. No. 4,806,928; and the inductive coupler 19 is shown in FIG. 1 simply as an alternative system for supplying power to a well tool stationed at a lower depth interval in the borehole 14 as well as for transmitting electrical signals between the surface and that other tool. Accordingly, as will subsequently become more apparent, the new and improved tool-achoring and tool-actuating systems of the wireline tool 10 are respectively independent of the power and signal transmission system fully described in the aformentioned U.S. Pat. No. 4,806,928; and the wireline tool of the invention is itself considered to be effective for selectively operating various types of well tools from the surface by means of successive controlled upward and downward movements of the suspension cable 11.

As is typical, the TCP perforator (not illustrated in the drawings) which has been previously positioned in the casing 13 below the wireline tool 10 has a plurality of shaped explosive charges mounted at longitudinally-spaced intervals within an elongated fluid-tight hollow carrier for perforating the casing and the cement sheath 15 for gaining fluid communication with the adjacent earth formations around the borehole 14. To detonate these shaped charges, a detonating cord of suitable length is arranged within the carrier within detonating proximity of the shaped charges and extended through an upright tubular extension 20 on the upper end of the carrier and coupled to a suitable booster charge disposed in a fluid-tight housing 21 on the upper end of the tubular extension. The booster charge in the fluid-tight housing 21 is a relatively-safe secondary explosive that is not susceptible to spurious electomagnetic energy. Thus, a TCP perforator carrying the booster charge in the housing 21 can be safely handled while the perforator is still at the surface. As will be subsequently described by reference to FIGS. 3–6, the TCP perforator can be detonated only after the wireline tool 10 has been lowered through the tubing string 12 and positioned so that an explosive charge (not seen in FIG. 1) carried by the wireline tool is in detonating proximity of the enclosed housing 21. Hereagain, it must be understood that the new and improved tool-anchoring and tool-actuating systems of the wireline tool 10 of the invention are not considered as being limited to service with only certain classes of well tools with explosive devices much less as being restricted to any particular type of TCP perforator such as those generally described above.

Turning now to FIGS. 2A–2G, successive cross-sectioned elevational views are shown of a preferred embodiment of the new and improved selectively-operated wireline tool 10 having tool-anchoring and tool-actuating systems respectively incorporating the principles of the invention and cooperatively arranged to control another well tool such as the previously-described TCP perforator. The tool 10 is depicted in FIGS. 2A–2G as being in its initial or so-called "running-in" position. As illustrated, the wireline tool 10 includes a tubular upper body member 30 (FIGS. 2A and 2B) which is telescopically disposed over the reduced-diameter upper extension 31 of an elongated tubular lower body 32 (FIGS. 2B–2G) which together represent the main body of the tool 10. As is typical, the several tool bodies 30–32 are respectively comprised of a plurality of tandemly-coupled sections which are appropriately arranged to facilitate the fabrication as well as the assembly and maintenance of the tool. It will, of course, be recognized that alternative design details may be employed for fashioning the tool 10 but without departing from the scope of the present invention. It should be noted that to facilitate the following description of the tool 10, minor constructional details are not described and the drawings have been somewhat simplified where it was considered possible to do so without detracting from the full and complete disclosure of the present invention.

Figure 2A:
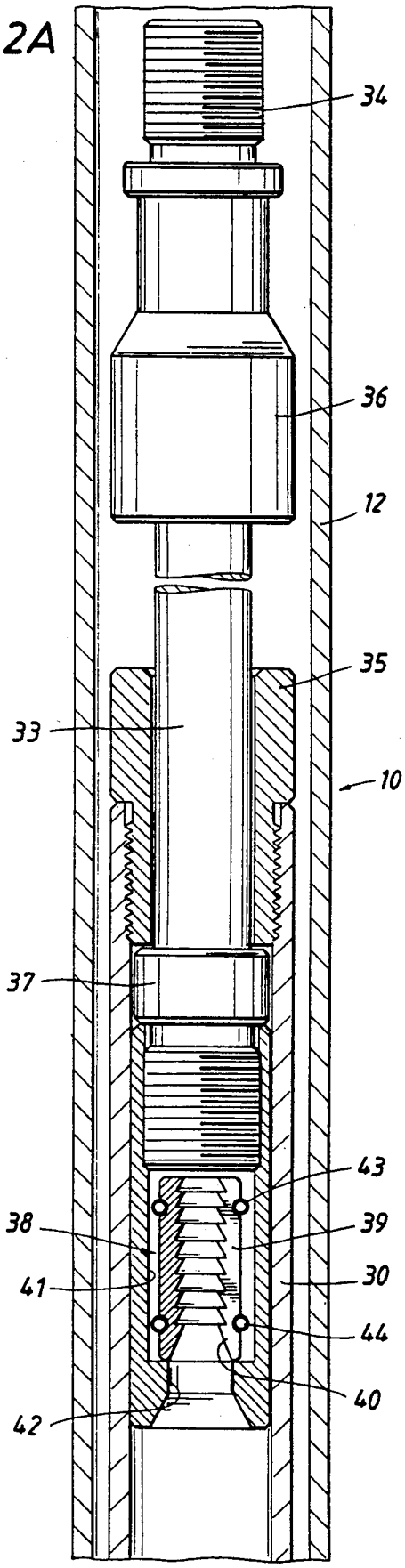
FIGS. 2A–2G are successive cross-sectioned elevational views of the wireline tool seen in FIG. 1 depicting a preferred embodiment of the tool-actuating and tool-anchoring systems of that tool.

As shown in FIG. 2A, the upper portion of the wireline tool 10 including an elongated actuating mandrel 33 having an upper threaded end portion 34 to facilitate tandemly coupling of the tool to other auxiliary devices such as the pressure recorder 18 which, as previously discussed by reference to FIG. 1, are collectively supported by the suspension cable 11 for measuring one or more characteristics of well bore fluids. As depicted in FIG. 2A, the actuating mandrel 33 is telescopically disposed within an annular end member 35 comprising the upper end of the tool body 30. The actuating mandrel 33 is cooperatively arranged within the upper tool body 30 to be freely moved upwardly and downwardly over a travel span collectively established by the longitudinal spacings between the opposed faces of the annular end member 35 and enlarged-diameter shoulders 36 and 37 which are respectively arranged on the upper and lower end portions of the actuating mandrel. It will be appreciated, however, that when the wireline tool is being lowered into the tubing string 12, the actuating mandrel 33 will be in its illustrated fully-extended position with the lower mandrel shoulder 37 engaged against the lower face of the annular end member 35 so that the full weight of the tool 10 will be carried by the wireline cable 11. As will subsequently be explained by reference to FIGS. 3–6, it will be realized that the actuating mandrel 33 will remain in this fully-extended or upper operating position until the wireline tool 10 has been anchored at a selected location in the tubing string 12 and the cable 11 has been slacked off sufficiently to cause the actuating mandrel to be selectively shifted downwardly relative to the upper tool body 30 to a telescoped or lower operating position established by the engagement of the upper mandrel shoulder 36 with the upper face of the end memeber 35.

As indicated generally at 38, the new and improved wireline tool 10 of the invention further includes selectively-operable latching means mounted on the lower end of the actuating mandrel 33. The preferred embodiment of the latching means 38 includes an internally-threaded split nut such as may be arranged from a plurality of sectoral or wedge-shaped segments 39 having teeth, as at 40, formed along one longitudinal edge of each segment that respectively define a flat upper face and a downwardly-inclined lower face. The toothed segments 39 are loosely disposed in an upright position between the upper and lower end surfaces of a cavity 41 provided in the lower end of the actuating mandrel 33; and the upright segments are spatially disposed around the cavity with their teeth 40 directed inwardly for collectively defining a cylindrical latching member with an axial bore that is accessible by way of a central longitudinal passage 42 in the lower end of the actuating mandrel. The assembled sectoral segments 39 are baised inwardly by means such as coiled garter springs 43 and 44 that are mounted around the upper and lower ends of the grouped latch segments for normally maintaining them in their respective contracted positioned depicted in FIG. 2A.

Figure 2B:
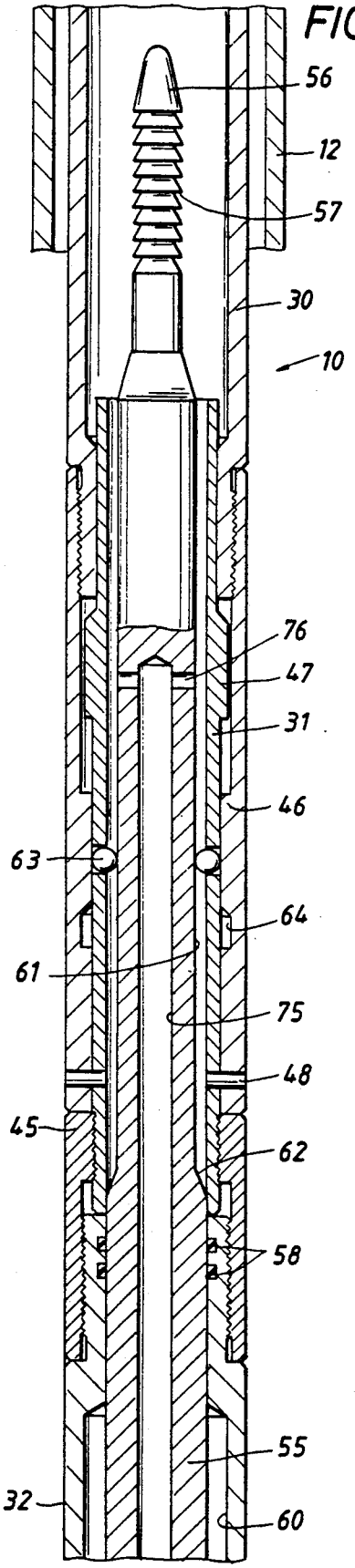
Figure 2C:
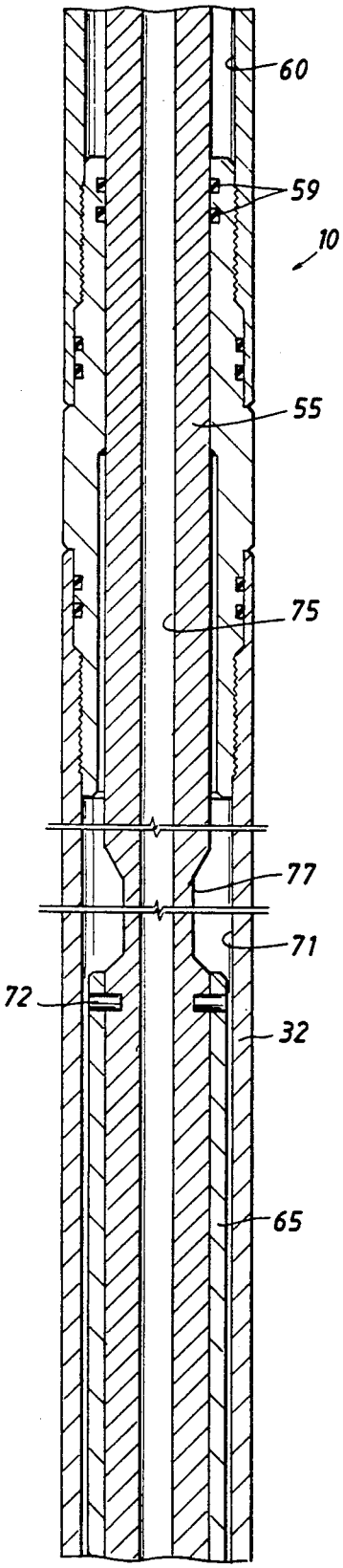
Figure 2D:
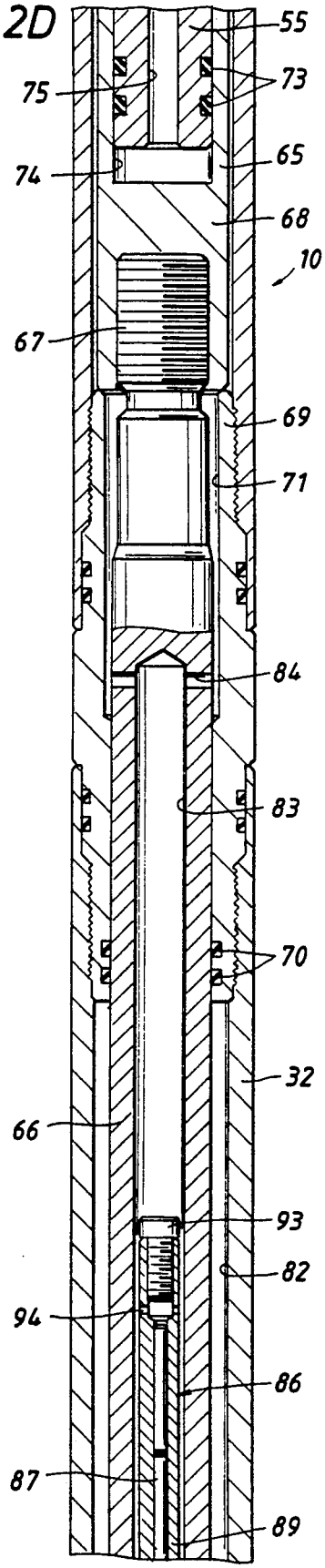

Turning now to FIGS. 2B–2D, the upper body 30 is depicted as having its lower end telescopically disposed over the reduced-diameter upper extension 31 of the main tool body 32. As shown in FIG. 2B, the lower end of the upper tool body 30 is engaged with an upwardly-facing shoulder 45 representing the upper end of the main tool body and thereby establishing the lower telescoped position of the upper tool body 30 in relation to the main tool body 32. To establish the upper extended position of the upper tool body 30 relative to the main tool body, and inwardly-enlarged internal shoulder 46 is arranged in the upper tool body so as to be normally located a short distance below an outwardly-enlarged external shoulder 47 on the reduced-diameter upper extension 31 of the main tool body 32. The upper body 30 is initially coupled to the main tool body by means such as a shear pin 48 releasably securing the upper tool body to the reduced-diameter extension 31 of the main tool body 32. As will be explained by reference to FIGS. 3–6, the shear pin 48 is cooperatively arranged to retain the lower end of the upper tool body 30 abutted on the upwardly-facing shoulder 45 on the main body 32 until the upper tool body is pulled upwardly with sufficient force to fail the shear pin.

As illustrated in FIGS. 2B–2D, an elongated mandrel 55 is slidably arranged in the main tool body 32 with its upper portion extended upwardly through the reduced-diameter extension member 31 of the main body 32 and terminated by an upright male coupling member 56 having external threads 57 which are complemental to the internal threads 40 on the latch segments 39. The elongated mandrel 55 is fluidly sealed in relation to the upper portion of the tool body by means such as spatially-disposed upper and lower O-rings 58 and 59 cooperatively arranged on the body for defining a normally-enclosed upper chamber 60 within the main tool body 32 around the mid-portion of the elongated mandrel.

It will be noted from FIG. 2B that, as shown generally at 61, the uppermost portion of the elongated mandrel 55 is reduced in diameter for defining an upwardly-facing mandrel shoulder 62 as well as an enlarged annular space above the O-rings 58 between the reduced-diameter mandrel portion and the inner wall surface of the extension member 31. To provide a selectively-retractable inwardly-directed shoulder on the mid-portion of the extension member 31 one or more balls 63 are movably disposed in lateral openings in the reduced-diameter extension member 31 below the shoulder 47 to normally position the balls where their forward portions are engaged against the inner surface of the movable upper body 30 and their rearward portions are projected into the enlarged annular space around the reduced-diameter portion 61 of the mandrel 55. It will be noted from FIGS. 2B–2D that so long as the shear pin 48 is coupling the upper tool body 30 to the upper extension member 31, the mandrel 55 can be moved upwardly over a limited travel span in relation to the main tool body 32 only until the upwardly-facing mandrel shoulder 62 is engaged with the inwardly-projecting rearward portions of the balls 63. However, as will be described by reference to FIGS. 3–6, once sufficient tension has been applied to the suspension cable 11 to selectively fail the shear pin 48 during the course of operation of the wireline tool 10, the upper tool body 30 will then be raised in relation to the main tool body 32 for positioning an inwardly-facing circumferential recess 64 in the inner wall of the tool body adjacent to the balls 63. Once the circumferential recess 64 is aligned with the balls 63, the upward movement of the mandrel 55 will engage the mandrel shoulder 62 against the rearward portions of the balls and shift the balls outwardly to dispose their forward portions in the recess. Once this occurs, the mandrel 55 will thereafter be free to be selectively raised to a higher operating position in relation to the main tool body 32 during the further operation of the wireline tool 10.

As depicted in FIGS. 2C and 2D, the lower portion of the elongated mandrel 55 is coaxially disposed within an upwardly-opening longitudinal bore defined in an upright extension member 65 which is mounted on the upper end of an actuating mandrel 66 coaxially disposed in the lower portion of the main tool body 32. The actuating mandrel 66 is dependently coupled to the lower end of the extension member by means such as a threaded connection 67 in the transverse lower end wall 68 of the extension member 65 and initially supported on an inwardly-projecting shoulder 69 in the main body 32 which determines the lower operating position of the actuating mandrel. The upper portion of the mandrel 66 is fluidly sealed in relation to the main tool body 32 by O-rings 70 cooperatively arranged within the main tool body for defining an enclosed intermediate chamber 71 in the annular space around the actuating mandrel above those O-rings which extends on upwardly in the annular space around the mandrel 55 which is terminated by the O-rings 59.

The mandrel 55 is releasably secured in its depicted initial position by means such as a shear pin 72 coupling the mandrel to the upright extension 65 of the actuating mandrel 66. The lower end of the mandrel 55 is fluidly sealed in the extension member 65 by one or more O-rings 73 which define an enclosed chamber 74 in the extension member between the lower end of the mandrel 55 and the transverse wall 68 closing off the lower end of the axial bore in the extension member. It should be noted that these O-rings 73 further serve to block communication between the chamber 74 and the intermediate chamber 71 by way of the annular space between the enlongated mandrel 55 and the internal wall of the upright extension 65. A longitudinal passage 75 is extended through the elongated mandrel 55 and terminated at its upper end by lateral ports 76 opening into the axial bore of the upright extension member 31 of the main tool body 32 to provide a bypass passage for communicating fluids in the tubing string 12 with the enclosed chamber 74 and, thereby, equalizing the pressure forces acting on the upper and lower ends of the elongated mandrel. For reasons which will be later explained by reference to FIGS. 3–6, the outer diameter of an intermediate portion of the elongated mandrel 55 is reduced moderately as indicated generally at 77.

Figure 2E:
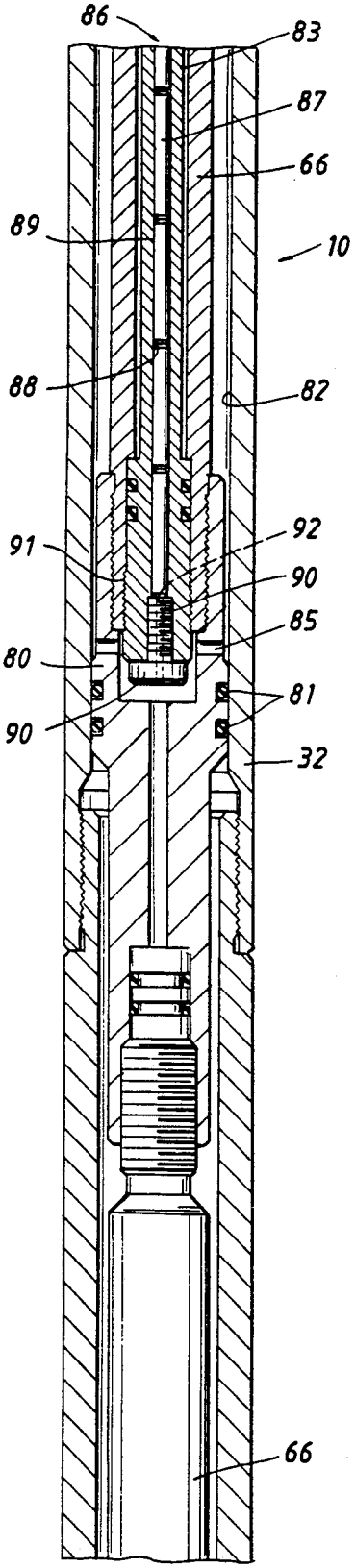
Figure 2F:
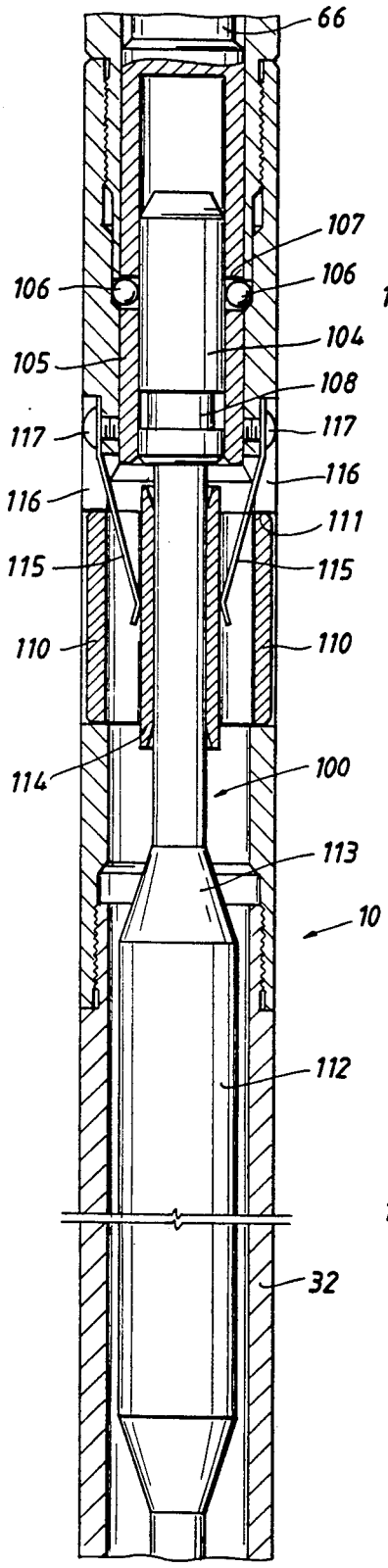
Figure 2G:
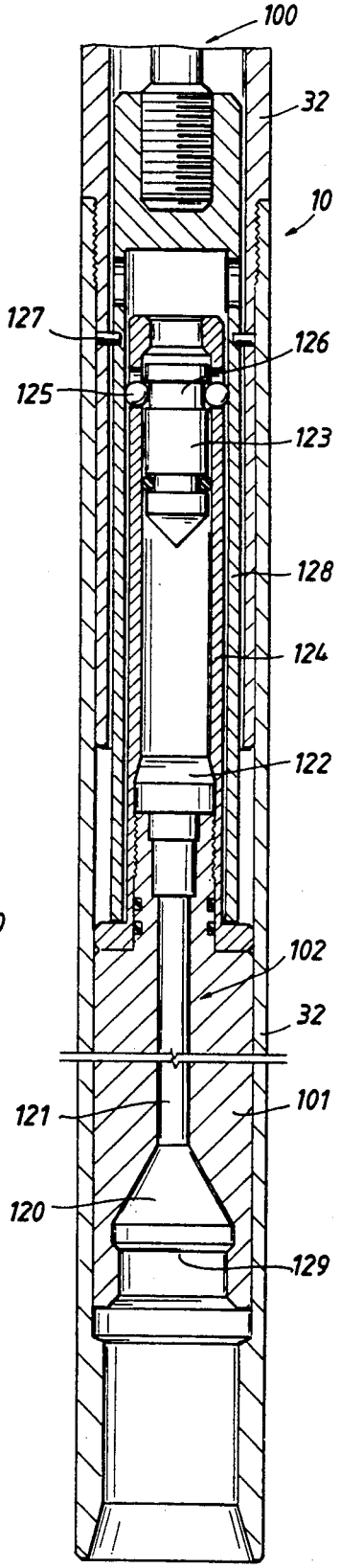

Turning now to FIGS. 2E–2G, the actuating mandrel 66 is shown as including an enlarged-diameter lower end portion 80 that serves as a piston member coaxially disposed in the longitudinal bore in the lower portion of the main tool body 32. To make the mandrel 66 operable in response to the hydrostatic pressure of well bore fluids, O-rings 81 are cooperatively arranged on the enlarged-diameter piston 80 to define an enclosed lower chamber 82 inside of the main tool body 32 in the annular space around the actuating mandrel 66 which is bounded at its upper end by the O-rings 70 (FIG. 2D) and at its lower end by the O-rings 81. As best seen in FIGS. 2D and 2E, the pressure-actuated mandrel 66 is provided with an elongated longitudinal passage 83 which extends for substantially the full length of the mandrel and is closed at its upper and lower ends. The mandrel 66 also includes one or more lateral ports 84 for communicating the upper end of the longitudinal passage 83 through the mandrel with the annular space 71 defined in the tool body 32 around the upper portion of the pressure-actuated mandrel above the O-rings 70. One or more lateral ports 85 are arranged in the pressure-actuated mandrel 66 for communicating the lower end of the longitudinal passage 83 in the mandrel with the annular space 82 defined in the tool body 32 around the lower portion of the pressure-actuated mandrel which extends downwardly below the O-rings 70.

Those skilled in the art will, of course, recognize that when the hydrostatic pressure of well fluids is shifting the pressure-actuated mandrel 66 upwardly, the upward travel of the actuating mandrel 66 in relation to the main tool body 32 will also be effective for moving the enlarged-diameter piston member 80 upwardly in the enclosed annular space 82 and thereby displace fluids contained in that space through the ports 85 and into the lower end of the longitudinal passage 83 through the actuating mandrel. The fluids displaced from the annular space 82 will, of course, be forced upwardly through the passage 83 and discharged by way of the ports 84 at the upper end of the passage into the enclosed annular space 71 that is defined within the tool body 32 around the upper portion of the pressure-actuated mandrel and the lower portion of the elongated mandrel 55 above the O-rings 70. In other words, the upward travel of the enlarged-diameter piston member 80 on the lower end of the pressure-actuated mandrel 66 is effective for displacing fluids from the lower annular space 82 below the O-rings 70 through the longitudinal passage 83 and into the upper annular space 71 above the O-rings 70.

It will, of course, be appreciated that the rate at which fluids are displaced from the lower annular space 82 into the upper annular space 71 can be controlled by installing flow-restricting means such as indicated generally at 86 in the longitudinal passage 83. In the preferred manner of arranging the flow-restricting means 86, one or more cylindrical metering rods 87 are cooperatively disposed in a tandem arrangement within the axial bore 88 through an elongated metering tube 89; and a threaded end plug 90 is installed in the lower end of the tube for retaining the metering rods in their tandem arrangement. The metering tube 89 is coaxially mounted within the longitudinal passage 83 through the piston-actuated mandrel 66 and secured therein by means such as mating threads 91 on their adjacent lower ends. A longitudinal passage 92 extending through the threaded end plug 90 provides communication between the annular space 82 outside of the pressure-actuated mandrel 66 and the lower portion of the axial bore 88 in the elongated metering tube 89. In a similar fashion, the upper end of the metering tube 89 is closed by a threaded end plug 93 and ports 94 are arranged in the metering tube for communicating the upper portion of the axial bore 88 through the metering tube with the upper portion of the longitudinal passage 83 in the pressure-actuated mandrel 66.

It will be appreciated, therefore, that by virtue of the flow-restricting means 86, whenever the actuating mandrel 66 is moved upwardly in relation to the main tool body 32, the rate at which the piston member 80 will displace fluids from the lower annular space 82 into the upper annular space 71 will be wholly dependent upon the particular fluid in the lower space as well as the design criteria of the flow-restricting means. It will, of course, be necessary to establish the criteria used to design the flow-restricting means 86 by way of routine calculations as well as by experiential testing of various designs with selected fluids under representative test conditions.

It should be noted that by virtue of the particular design for the flow-restricting means 86, the flow-restricting means can be readily modified as may be needed for any particular operating situation. By using precise dimensions to fashion the metering rods 87 and the axial bore 88 in the metering tube 89, the minute annular space defined between the rods and the metering tube can be arranged to carefully control the speed at which the actuating mandrel 66 will be permitted to move upwardly in the main tool body 32 during a particular operating situation. It should also be recognized that the metering tube 89 depicted in the drawings is totally self-contained so that a set of several metering tubes respectively containing metering rods 87 of different dimensions can be readily designed to give the operator a choice as to which of several metering tubes is most appropriate to meet particular operation conditions. Those skilled in the art will, of course, recognize that the installation of one of the metering tubes 89 can be readily carried out while the wireline tool 10 is being prepared for a particular operation.

As shown in FIGS. 2F and 2G, an elongated actuating member 100 is coaxially disposed in the lower portion of the main tool body 32 and supported at its lower end on a thick-walled tubular body 101 which is mounted in the lower end of the main tool body. As will be subsequently described, the thick-walled body 101 is arranged to carry a downwardly-directed, mechanically-detonated explosive assembly as shown generally at 102. A shear pin 127 is cooperatively arranged to releasably secure the actuating member 100 to the main tool body 32.

In the preferred embodiment of the new and improved wireline tool 10, the actuating member 100 includes an enlarged upper head 104 coaxially fitted into a sleeve 105 dependently supported from the lower end of the pressure-actuated mandrel 66. A set of two or more latching balls 106 are loosely disposed in complemental lateral openings in the depending sleeve 105 and cooperatively arranged so that the enlarged head 104 on the actuating member 100 will initially position the forward portions of the balls in an inwardly-facing circumferential recess 107 extending around the adjacent internal wall surface of the tool body 32. As will be explained later by reference to FIGS. 3–6, an outwardly-facing circumferential groove 108 is arranged around the enlarged head 104 for subsequently receiving the rearward portions of the latching balls 106 for thereafter latching the actuating member 100 to the pressure-actuated mandrel 66.

As best seen in FIG. 2F, a pair of oppositely-directed anchor members 110 are cooperatively disposed in an upright position within lateral openings 111 on opposite sides of the main tool body 32; and these shoes are arranged for movement outwardly from their respective retracted positions to extended positions in anchoring engagement with the adjacent internal wall surface of the tubing string 12. To selectively extend these anchor members 110, the intermediate portion of the actuating member 100 is enlarged, as at 122, and its upper end is shaped to define an upwardly-inclined frustoconical surface 113 which will be moved upwardly into contact with the opposing surfaces of the inwardly-facing upright base portions 114 on the anchor members for shifting them outwardly when the actuating member 100 is carried upwardly in relation to the main tool body 32 after the actuating member 100 is latched to the actuating mandrel 66. To retain the anchor members 110 in their illustrated retracted positions, biasing means are provided such as depending elongated arcuate springs 115 cooperatively arranged on opposite sides of the tool body 32 for normally urging the anchor members inwardly against the anchor-actuating member 100. As illustrated, in the preferred embodiment of the new and improved wireline tool 10, the upper ends of the biasing springs 115 are positioned in slots 116 extended upwardly from the lateral openings 111 on opposite sides of the main tool body 32; and the upper ends of the springs are respectively secured to the tool body by screws 117. The springs 115 are further arranged with their respective depending portions extended through the upper ends of the lateral openings 111 and positioned so that the reversely-curved lower ends of the springs are engaged on the outer faces of the base portions 114 of the anchor members 110.

As shown in FIG. 2G, in the preferred embodiment of the new and improved wireline tool 10 of the present invention, the mechanically-detonated explosive assembly 102 is comprised of the thick-walled tubular body 101 having its lower end cooperatively counterbored to carry a shaped explosive charge 120. The shaped charge 120 is axially aligned is the tool body 32 and directed downwardly for detonating the explosive booster charge mounted in the enclosed housing 21 (FIG. 1). The explosive assembly 102 also includes a short length of a detonating cord 121 extending through the longitudinal bore in the thick-walled body and having its opposite ends respectively arranged in detonating proximity of the primary explosive in the shaped charge 120 and a typical percussion detonator 122 that is mounted in an upwardly-facing counterbored recess in the upper end of the body 101.

A short firing pin 123 is releasably suspended in the bore of the thick-walled body 101 above the percussion detonator 122. In the preferred manner of suspending the firing pin 123, an elongated sleeve 124 is coaxially disposed around the firing pin and supported in an upright position on the upper face of the body 101. Latching balls 125 are operatively disposed in lateral openings arranged near the upper end of the sleeve 124 so as to position the forward portions of the balls in a circumferential recess 126 defined around the firing pin. A sleeve 128 which is dependently suspended from the lower end of the actuating member 100 is cooperatively arranged to reliably retain the balls 125 in latching engagement with the firing pin 123 until the sleeve is raised sufficiently to allow the balls to move out of the recess 126. Once this occurs, the hydrostatic pressure of the well bore fluids acting on the upper end of the firing pin 123 will be effective for driving the pin against the percussion detonator 122 with sufficient force to reliably set it off. As will be subsequently explained by reference to FIGS. 3–6, a shear pin 127 of a predetermined strength is cooperatively arranged for releasably securing the actuating member 100 to the main tool body 32.

Figure 3:
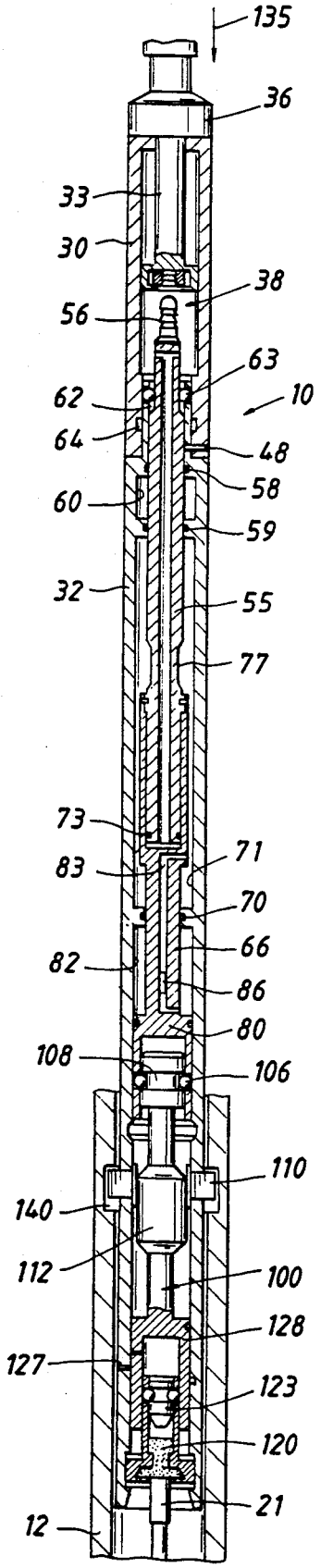
FIGS. 3–6 are schematic views of the wireline tool shown in FIGS. 2A–2G depicting the successive operation of that tool as it is being utilized in accordance with the practice of the new and improved methods of the present invention for actuating a typical TCP perforator which has been previously installed in a well bore.

Turning now to FIG. 3, the new and improved wireline tool 10 is schematically depicted as it will appear when it has been stationed at a selected depth location in a tubing string 12 that has been previously run into a well bore as shown in FIG. 1. Once the wireline tool 10 has been stationed at its selected depth location, it will be seen that the shaped explosive charge 120 mounted on the lower end of the tool will be in detonating proximity of the explosive charge in the fluid-tight housing 21. As previously discussed by reference to FIG. 1, it will be recalled that the fluid-tight housing 21 carries an explosive detonator that is supported by an upright extension mounted on the upper end of a TCP perforator that was previously positioned at this selected depth location when the tubing string 12 was installed in the well bore.

As shown in FIG. 3, the wireline tool 10 has been lowered through the tubing string 12 and has now been stationed with the transverse barrier 129 closing the lower end of the downwardly-directed shaped charge 120 resting on the upper end of the fluid-tight housing 21. This preparatory action is, of course, best carried out by simply lowering the wireline tool 10 into the tubing string 12 until the transverse barrier 129 contacts the upstanding charge housing 21. As indicated by the directional arrow 135, in the initial movement of the cable 11 supporting the wireline tool 10, the winch at the surface carries the cable is operated for lowering the cable a moderate distance. By slacking off the cable 11 at the surface, the resultant initial downward movement of the suspension cable will be effective for enabling the actuating mandrel 33 to move downwardly until its enlarged upper shoulder 36 is resting on the upper end surface of the tool body 30. Then, since the wireline tool 10 will not be supported by the slacked-off cable 11, the weight of the wireline tool will be effective for breaking the shear pin 127 initially coupling the main tool body 32 to the sleeve 128 depending from the lower end of the actuating member 100.

Since the depending sleeve 128 is engaged with the body 101 carrying the shaped charge 120, once the shear pin 127 fails, the actuating member 100 will initially remain stationary as the tool body 32 is moved a short distance further downwardly in relation to the actuating member. It will be recalled that the mandrels 55 and 56 are initially coupled together by means of the shear pin 72. Thus, as illustrated in FIG. 3, the resulting downward movement of the main tool body 32 will carry the mandrels 55 and 66 downwardly until the latching balls 106 carried by the sleeve 105 are moved into juxtaposition with the groove 108 around the enlarged upper head 104 on the actuating member 100. When that occurs, the balls 106 will be shifted inwardly for retracting the rearward portions of these balls from the groove 107 in the main tool body 32 as the forward portions of the balls are advanced into the groove 108. This inward movement of the latching balls 106 will, therefore, be effective for releasing the two mandrels 55 and 66 from their initial latched positions on the main tool body 32 and simultaneously coupling the pressure-actuated mandrel 66 to the anchor-actuating member 100 as required for subsequent operation of the wireline tool 10.

Once the pressure-actuated mandrel 66 has been released from the main body 32, the hydrostatic pressure of the fluids in the tubing string 12 acting on the lower face of the enlarged piston member 80 will be urging the mandrel upwardly in relation to the main tool body. Thus, as the pressure-actuated mandrel is being urged upwardly, the piston member 80 on the mandrel 66 will be displacing the fluid initially contained in the lower chamber 82 from that chamber at a controlled flow rate which is selectively regulated by the particular flow-restricting means 86 disposed in the longitudinal mandrel passage 83 at that time. Hereagain, as previously discussed, it will be recalled that the upward travel of the pressure-actuated mandrel 66 will be controlled by the particular arrangement of the flow-restricting means 86; and that the choice of which of several flow restrictors that is to be employed for a forthcoming operation will be dependent upon the specific parameters of the flow-restricting means as well as the anticipated well bore conditions.

In FIGS. 1 and 3 the tubing string 12 is illustrated as including a landing nipple 140 which was appropriately installed in the tubing string to be reliably stationed at a selected depth location in the well bore as the tubing string was progressively assembled and lowered into the well bore. In this manner, in practicing the present invention, the new and improved wireline tool 10 is initially stationed at a selected depth location in the tubing string 12 where the still-retracted anchor shoes 110 will be appropriately aligned with the landing nipple 140. Then, once the latching balls 106 have tandemly coupled the actuating member 100 to the pressure-actuated mandrel 66, the continuing upward travel of the mandrel will be effective for progressively extending the anchor shoes 110 as the enlarged-diameter portion 112 of the anchor-actuating member is shifted upwardly behind the shoes.

The extension of the anchor shoes 110 will, of course, be effective for anchoring the wireline tool 10 at a selected depth location in the tubing string 12. Moreover, once the shoes 110 have been fully extended, the enlarged-diameter portion 112 of the anchor-actuating member 100 will maintain the anchor shoes in their extended positions. As will be subsequently described, the shoes 110 will be retracted by the final upward movement of the suspension cable 11 for pulling the anchor-actuating member 100 upwardly sufficiently to elevate the enlarged-diameter mandrel portion 112 above the opposed base portions 114 of the anchor shoes. When this occurs, the arcuate biasing springs 115 will function for returning the anchor shoes 110 to their initial retracted positions adjacent to the tool body 32.

In accordance with the principles of the present invention it has been found that instead of completely filling the lower chamber 82, the performance of the wireline tool 10 is enhanced by only partially filling the lower chamber 82 with a suitable hydraulic oil and leaving an air space in a significant portion of the lower chamber. In this manner, the initial travel of the actuating mandrel 66 will be relatively rapid since the piston 80 will first function by simply compressing the air in the upper portion of the lower chamber 82. However, once this trapped air is compressed, the subsequent travel of the pressure-actuated mandrel 66 will be greatly retarded since the flow-restricting means 86 in the axial passage 83 will function to selectively regulate the flow of the oil from the lower chamber 82.

It will be appreciated, of course, that the rapid initial upward movement of the mandrel 66 is particularly effective for quickly anchoring the wireline tool 10 in the tubing string 12. By virtue of this rapid movement of the pressure-actuated mandrel 66, it can be reasonably anticipated that whenever the wireline tool 10 has been positioned at a selected depth location in the tubing string 12, the new and improved tool-anchoring system of the tool will function to insure that the tool is being anchored at that precise depth location. Those skilled in the art will, of course, readily appreciate the advantage of reliably anchoring the wireline tool 10 at a precise depth location.

Once all of the air has been compressed in the lower annular space 82 to enable the piston member 80 to achieve its initial rapid upward movement, a minor quantity of the oil in the chamber will be displaced from the lower chamber as the pressure-actuated mandrel 66 is then slowly moved further upwardly until it is ultimately halted when the mandrel shoulder 62 is engaged with the inwardly-projecting rearward portions of the balls 63 mounted in the upper extension member 31. It will be recognized that even though the pressure-actuated mandrel 66 has been temporarily halted, the hydrostatic pressure in the tubing string 12 acting on the piston member 80 will be effective for maintaining the oil in the lower chamber 82 at an elevated pressure level to prevent the mandrel 66 from shifting downwardly.

This will, of course, insure that the anchor shoes 110 will be respectively maintained in their outwardly-extended positions in the landing nipple 140 by the enlarged-diameter body portion 112 between the base portions 114 of the anchor shoes since the actuating mandrel 66 is positively secured against being moved either upwardly or downwardly for however long the wireline tool 10 is stationed in the tubing string 12.

Moreover, it will be noted that even though the above-described upward movement of the actuating mandrel 66 raised the elongated mandrel 55, the upright male coupling member 56 will still be spatially disposed below the latching means 38 carried by the actuating mandrel 33 so long as the shear pin 72 is intercoupling the mandrels 55 and 66 and these two intercoupled mandrels respectivley remain in their operating positions as depicted in FIG. 3.

Figure 4:
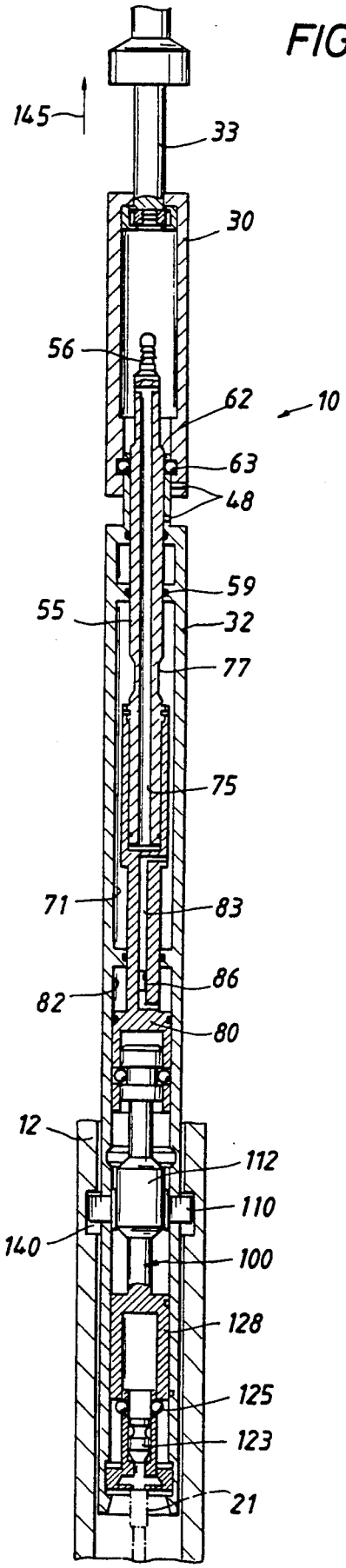

Once it is decided to proceed further with the operation of the wireline tool 10 it is necessary only to break the shear pin 48 releasably securing the upper body 30 to the reduced-diameter extension 31 of the main tool body 32. To accomplish this, as indicated by the directional arrow 145 in FIG. 4, the wireline cable 11 is raised until the lower shoulder 37 on the actuating mandrel 33 is engaged with the underside of the annular end member 35 and sufficient tension is applied to the cable for breaking the shear pin 48. As depicted in FIG. 4 it will be appreciated that once this interim upward movement of the cable 11 has broken the shear pin 48, continued tension on the cable will then elevate the upper tool body 30 sufficiently to bring the inwardly-opening circumferential groove 64 in the upper body into alignment with the latching balls 62. At the same time, the upwardly-directed hydrostatic pressure forces which are acting on the piston member 80 will raise the intercoupled mandrels 55 and 66 upwardly in relation to the main tool body 32. This upward movement of the intercoupled mandrels 55 and 66 will then carry the reduced-diameter portion 61 of the actuating mandrel 55 above the balls 63. Once the reduced-diameter mandrel portion 61 moves above the latching balls, the full-diameter lower portion of the actuating mandrel 55 will thereafter be effective to retain the balls 63 in an ineffective position within the circumferential groove 64 in the upper tool body 30.

From FIG. 4 it will be realized that the upward movement of the intercoupled mandrels 55 and 66 in relation to the main tool body 32 will also be effective for raising the actuating member 100 which is dependently supported below the pressure-actuated mandrel 66; and the sleeve 128 which is dependently suspended below the actuating member will, in turn, itself be raised in relation to the stationary upright sleeve 124 which is threadedly coupled to the upper end of the thick-walled body 101.

From FIGS. 2G and 4 it will be appreciated that once the lower end of the depending sleeve 128 is raised above the upper end of the upright sleeve 124, the latching balls 125 will be freed from their initial confinement in the outwardly-directed circumferential groove 126 around the firing pin 123. Once this occurs, the downwardly-directed pressure forces imposed on the firing pin 123 will be effective for forcibly driving the firing pin downwardly against the impact-responsive detonator 122 to reliably set off the detonator. As previously discussed, the detonation of the impact-responsive detonator 122 will set off the explosive charge contained in the fluid-tight housing 21 for reliably actuating the TCP perforator therebelow. It should be realized that by sealingly mounting the firing pin 123 within the fluid-tight axial bore of the upright sleeve 124, the hydrostatic pressure of the well bore fluids will always be imposed on the firing pin 123. This will, of course, insure that the detonator 122 will be selectively set off by the interim upward movement of the cable 11.

It will be appreciated that the pressure forces acting on the piston member 80 will elevate the intercoupled mandrels 55 and 66 at a speed which is governed by the rate at which the oil is displaced from the lower annular space 82 and passes through the flow-restricting means 86 into the intermediate annular space 71. From the previous discussion of FIG. 3 it will be recalled that the air initially contained in the lower annular space 82 will be compressed and a minor amount of oil will have been displaced from that space by the time that the intercoupled mandrels 55 and 66 are halted by the engagement of the mandrel shoulder 62 with the balls 63. Thereafter, once the intercoupled mandrels 55 and 66 resume their upward travel as described by reference to FIG. 4, the piston member 80 will be operative for displacing the remaining oil from the lower annular space 82. For reasons that will subsequently be explained by reference to FIG. 5, the tension which was applied to the suspension cable 11 during the interim upward movement of the cable to selectively detonate the charge 120 is maintained for retaining the actuating mandrel 33 in its elevated position shown in FIG. 4.

It will, of course, be recognized that the upward travel of the intercoupled mandrels 55 and 66 will be halted once the oil that is being displaced from the lower annular space 82 fills the intermediate annular space 71. Accordingly, the overall travel of the actuating mandrel 66 can be selectively regulated by the amount of oil that is initially installed in the annular spaces 71 and 82. For example, as previously discussed, by partially filling the lower annular space 82, the travel of the actuating mandrel 66 required to engage the mandrel shoulder 62 with the balls 63 can be selectively divided into an initial rapid stroke and a subsequent retarded stroke, with the respective lengths of those strokes depending on the amount of air which is initially left in the lower space. A measure of additional control can also be attained by initially installing a limited quantity of oil in the intermediate annular space 71 so as to selectively reduce the available volume in that space into which oil can be displaced from the lower annular space 82.

In any event, it will be appreciated that the continued upward travel of the two intercoupled mandrels 55 and 66 will be ultimately halted whenever the intermediate enclosed space 71 in the main tool body 32 is completely filled with oil that has been displaced from the lower enclosed space 82. Once this happens, the upright male coupling member 56 will have been carried to an elevated position where it is only a short distance below the depending latching means 38 carried by the actuating mandrel 33. It will be recognized, however, that this situation can continue so long as tension is maintained on the suspension cable during this interium upward movement of the cable 11. In this manner, should it be desired to obtain a prolonged series of real-time measurements (such as pressure measurements provided by the pressure recorder 18) after the TCP perforator has been fired by actuating the detonator 120, it is necessary only to maintain a moderate tension on the suspension cable 11 for retaining the actuating mandrel 33 in its elevated position relative to the upper body member 30. It will also be recalled that the anchor members 110 will be positively retained in their outwardly-extended anchoring positions so long as continued moderate tension is maintained on the suspension cable 11 for retaining the actuating mandrel 33 in its elevated position as depicted in FIG. 4. It will be understood that by keeping the enlarged-diameter mandrel portion 112 positioned between the base portions 114 of the anchor members 110, not even the loss of oil pressure in the annular space 82 will retract the anchor shoes from the landing nipple 140. The operational reliability of the wireline tool 10 is, therefore, not at all compromised by the failure or impairment of the hydraulic system employed with this tool.

Figure 5:
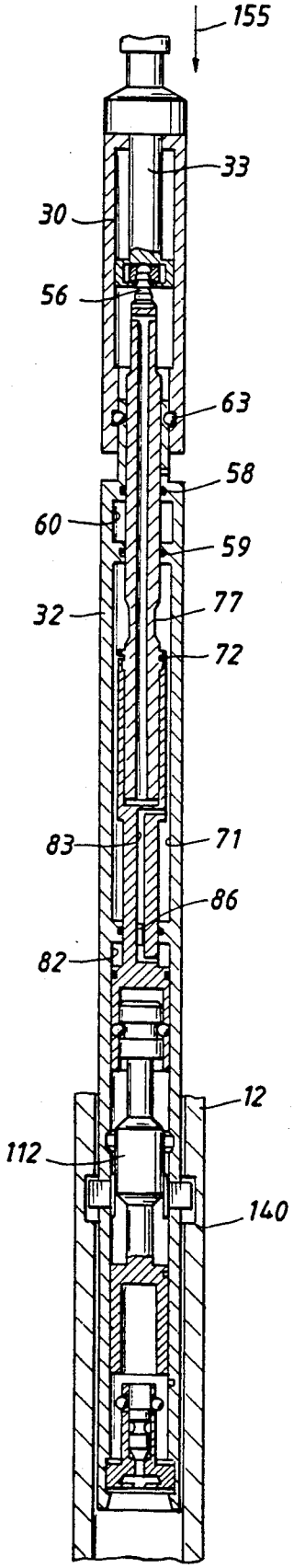

Turning now to FIG. 5, the new and improved wireline tool 10 is schematically depicted as it will appear when it is desired to retract the anchor members 110 from their extended anchoring positions in the landing nipple 140 in response to an interim downward movement of the suspension cable 11. As represented by the directional arrow 155, the cable 11 is sufficiently slacked off at the surface to allow the actuating mandrel 33 to be moved downwardly in relation to the upper body 30 of the wireline tool 10. When this interim downward movement of the cable 11 occurs, it will be appreciated that the actuating mandrel 33 will have moved downwardly a sufficient distance to position the depending latching means 38 over the upright male coupling member 56 for coengaging their respective complemental teeth 40 and 57. It will, of course, be appreciated that once the latching means 38 are moved downwardly over the upright male coupling member 56, the coengaged teeth 40 and 57 will securely latch the mandrel 33 to the intercoupled mandrels 55 and 66. Once the teeth 40 and 57 are coengaged, the latching means 38 can not be dislodged from the upright male coupling member 56.

Figure 6:
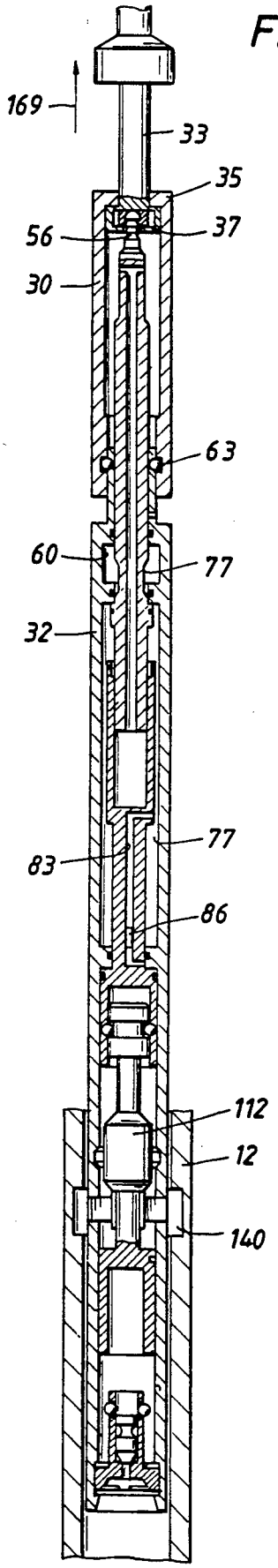

As depicted in FIG. 6, once the actuating mandrel 33 has been securely latched to the intercoupled mandrels 55 and 66, as shown by the directional arrow 165, tension can again be applied to the suspension cable 11 for raising the actuating mandrel 33 to its final elevated position where the lower mandrel shoulder 37 is engaged with the underside of the annular end member 35. Then, as the intercoupled mandrels 55 and 66 are moved further upwardly, the upper end of the upright sleeve 65 on the lower mandrel 66 will be raised into engagement with downwardly-facing body shoulder defining the upper end of the annular space 71. The continued upward travel of the elongated mandrel 55 will be effective to fail the shear pin 72 which has been releasably coupling the mandrels 55 and 66 to one another. It will be seen that since the mandrel 55 has a uniform diameter and is pressure-balanced by virture of the longitudinal passage 75 through the mandrel, the predetermined force required to fail the shear pin 72 will be relatively minimum.

It will also be appreciated that as mandrel 55 is moved upwardly by the final movement of the cable 11, the reduced-diameter intermediate portion 77 of the elongated mandrel 55 will be moved to a position where it is straddling the O-rings 59. Movement of the reduced-diameter mandrel portion 77 to this position will, of course, open the previously-closed intermediate annular space 71 so that the upwardly-directed hydrostatic pressure forces on the piston member 80 will be effective for shifting the anchor-actuating member 100 upwardly for raising the enlarged-diameter mandrel portion 122 above the opposed anchoring shoes 110 so that the biasing springs 115 will be able to retract the shoes.

Accordingly, it will be seen that the present invention has new and improved methods and apparatus for selectively initiating and anchoring various well tools from the surface including those carrying explosive devices. In particular, the present invention provides new and improved wireline tools with tool-anchoring and tool-actuating systems which are selectively operated by simply manipulating the suspension cable supporting the tools from the surface and without transmitting electrical power or control signals through the cable.

While only particular embodiments of the present invention and modes of practicing the invention have been described above and illustrated in the drawings, it is apparent that changes and modifications may be made without departing from the invention in its broader aspects; and, therefore, the aim in the claims which are appended hereto is to cover those changes and modifications which fall within the true spirit and scope of the invention.

What is claimed is:

1. A well tool arranged for suspension in a well bore from a cable and comprising:

a body;

means for dependently coupling said body to a cable including a mandrel telescopically arranged on said body and operable only after said body has been stationed at a selected depth location in said well bore for being shifted between a first position and a second position in response to a first movement and a second movement of said cable coupled to said mandrel;

an anchor on said body cooperatively arranged to be moved into and out of engagement with a well bore wall;

actuating means selectively operable when said body has been stationed at said selected depth location for engaging said anchor with said well bore wall in response to said first movement of said cable coupled to said mandrel shifting said mandrel to its said second position and for subsequently disengaging said anchor from said well bore wall in response to said second movement of said cable coupled to said mandrel shifting said mandrel to its said first position;

an inpact-actuated explosive on said body;

explosive-detonating means on said body including a movable detonating member, and biasing means operable for forcibly moving said detonating member against said impact-actuated explosive to achieve a high-order detonation thereof; and means releasably securing said detonating member to said body and operable for releasing said detonating member to be forcibly moved by said biasing means against said impact-actuated explosive solely in response to an interim first movement of a cable coupled to said mandrel applying a force of a predetermined magnitude to said mandrel during a selected time interval between an initial and a final cable movement.

2. The well tool of claim 1 further including means selectively operable only in response to an interim downward movement of a cable coupled to said mandrel following said interim upward cable movement for securing said mandrel to said actuating means before said mandrel is subsequently shifted to its said upper position for disengaging said anchor from a well bore wall in response to said final upward cable movement.

3. A well tool arranged for suspension in a well bore from a cable and comprising:

a body;

means for dependently coupling said body to a cable including a mandrel telescopically arranged on said body and operable only after said body has been stationed at a selected depth location in said well bore for being shifted between a first position and a second position in response to a first movement and a second movement of said cable coupled to said mandrel;

an anchor on said body cooperatively arranged to be moved into and out of engagement with a well bore wall;

actuating means selectively operable when said body has been stationed at said selected depth location for engaging said anchor with said well bore wall in response to said first movement of said cable coupled to said mandrel shifting said mandrel to its said second position and for subsequently disengaging said anchor from said well bore wall in response to said second movement of said cable coupled to said mandrel shifting said mandrel to its said first position;

an impact-actuated explosive on said body; and explosive-detonating means on said body including a movable detonating member, and biasing means operative only following an initial first cable movement for driving said detonating member against said impact-actuated explosive solely in response to a subsequent interim second movement of a cable coupled to said mandrel.

4. The well tool of claim 3 further including:

means operable for delaying the movement of said detonating member against said impact-actuated explosive for an extended time interval following said interim upward cable movement.

5. The well tool of claim 3 further including:

means operable for selectively retarding the release of said detonating member for a prolonged time interval following the application of said upward force of predetermined magnitude to said mandrel during said interim upward cable movement.

6. The well tool of claim 5 further including means selectively operable only in response to an interim downward movement of a cable coupled to said mandrel following said interim upward cable movement for securing said mandrel to said actuating means before said mandrel is subsequently shifted to its said upper position for disengaging said anchor from a well bore wall in response to said final upward cable movement.

7. The well tool of claim 6 further including:

sensor means arranged on said body for measuring at least one characteristic of well bore fluids.

8. A well tool arranged for suspension in a well bore from a cable and comprising:

a body;

means for dependently coupling said body to a cable including a mandrel telescopically arranged on said body and operable only after said body is stationed at a selected depth location in a well bore for being shifted between upper and lower positions in response to the upward and downward movements of a cable coupled to said mandrel;

tool-anchoring means including an anchor member arranged for movement between retracted and extended positions in relation to said body, an anchor actuator arranged on said body for movement between a first operating position where said anchor member is in its said retracted position and a second operating position for shifting said anchor member to its said extended position;

pressure-responsive actuating means on said body including a first fluid chamber arranged to initially contain predetermined volumes of air and a hydraulic fluid, a second initially-empty fluid chamber, means fluidly coupling said first and second fluid chambers including flow-restrictor means for regulating the flow of hydraulic fluid from said first fluid chamber into said second fluid chamber, and piston means cooperatively arranged in said first fluid chamber for rapidly moving in a first travel span from an inital position to an intermediate partially-telescoped position for compressing any air remaining in said first chamber and substantially filling the remaining space in said first fluid chamber with hydraulic fluid and thereafter slowly moving in a second travel span from said intermediate position to a final position for displacing hydraulic fluid from said remaining space of said first fluid chamber through said flow-restrictor means and into said second fluid chamber means;

first means normally latching said piston means and operable in response to the initial downward movement of a cable coupled to said mandrel while said body is stationed at a selected depth location in a well bore shifting said mandrel to its said lower position for thereby releasing said piston means for movement in said first travel span and rapidly shifting said anchor member to its said extended position; and second means operable in response to a final upward movement of a cable coupled to said mandrel shifting said mandrel to its said upper position for thereby discharging hydraulic fluid from said second fluid chamber means and releasing said piston means for movement in said second travel span and shifting said anchor member to its said retracted position when said body is to be moved from its said selected depth location in a well bore.

9. The well tool of claim 8 further including:

sensor means arranged on said body for measuring at least one characteristic of well bore fluids.

10. The well tool of claim 8 further including:

an explosive device on said body;

means operable in response to an interim movement of a cable coupled to said mandrel while said anchor member is in its said extended position for releasing said piston means for movement in said second travel span; and explosive-detonating means on said body operable in response to movement of said piston means in said second travel span for detonating said explosive device.

11. The well tool of claim 10 where said interim cable movement is an upward movement of a cable coupled to said mandrel applying a force of at least a predetermined magnitude thereto to detonate said explosive device following said interim upward movement.

12. The well tool of claim 8 further including:

an impact-actuated explosive on said body;

explosive-detonating means on said body including a movable detonating member, and biasing means operable for forcibly moving said detonating member against said impact-actuated explosive;

means releasably securing said detonating member to said body and operable for releasing said detonating member to be forcibly moved by said biasing means against said impact-actuated explosive solely in response to an interim upward movement of a cable coupled to said mandrel applying an upward force of a predetermined magnitude to said mandrel during a selected time interval between said initial and final cable movements.

13. The well tool of claim 12 further including:

means selectively operable only in response to an interim downward movement of a cable coupled to said mandrel following said interim upward cable movement for coupling said mandrel to said anchor actuator before said mandrel is shifted to its said upper position for returning said anchor to its said retracted position in response to said final upward cable movement.

14. The well tool of claim 8 further including:

an impact-actuated explosive on said body;

explosive-detonating means on said body including a movable detonating member, and pressure-biasing means operative only following said initial downward cable movement for driving said detonating member against said impact-actuated explosive;

means releasably securing said detonating member to said body and operable for releasing said detonating member to be driven against impact-actuated explosive solely in response to a subsequent interim upward movement of a cable coupled to said mandrel.

15. A well tool arranged to be suspended from a suspension cable and lowered into a tubing string for selectively detonating an initiating charge supported on a firing head on a tubing-conveyed perforator tandemly coupled in the tubing string and comprising:

a body arranged for passage through a tubing sting;

an impact-actuated explosive cooperatively arranged on said body for selectively detonating an initiating charge supported on a firing head on a tubing-conveyed perforator tandemly coupled in the tubing string;

means coupling said body to a suspension cable for being lowered through a tubing string to place said impact-actuated explosive in detonating proximity with the firing head of a tubing-conveyed perforator in the tubing string and including a mandrel telescopically arranged within said body and operable only after said body is engaged with the firing head for being shifted between upper and lower positions by upward and downward movements of a cable coupled to said mandrel;

tool-anchoring means including movable anchors on opposite sides of said body, and an anchor actuator cooperatively arranged for movement in said body between a first position where said anchor members are retracted and a second position where said anchor members are extended into engagement with the adjacent wall of a member in a tubing string above said tubing-conveyed perforator;

explosive-detonating means on said body including a movable firing pin, means releasably latching said firing pin to said body, and biasing means operable upon release of said firing pin for driving it against said impact-actuated explosive;

pressure-responsive actuating means operable by hydrostatic pressure of well bore fluids in the tubing string and including a first chamber initially containing predetermined quantities of a gas and a hydraulic fluid, a second substantially-empty chamber, means communicating said chambers including flow-restrictor means regulating the flow of a hydraulic fluid from said first chamber into said second chamber, and a piston cooperatively arranged in said first chamber for being rapidly advanced by said hydrostatic pressure in a first travel span to an intermediate position for compressing air ahead of said piston to initially fill the space in said first chamber with hydraulic fluid and then being slowly advanced by said hydrostatic pressure in a second travel span toward a final position for displacing hydraulic fluid from the remaining space in said first chamber and through said flow-restrictor means into said second chamber;

first means selectively operable in response to the initial downward movement of a cable coupled to said mandrel moving said mandrel to its said lower position for releasing said piston for movement by said hydrostatic pressure in its first travel span and thereby extending said anchor members; and second means selectively operable in response to an interim upward movement of a cable coupled to said mandrel moving said mandrel to its said upper position for releasing said piston for movement in its said second travel span and releasing said firing pin to be moved by said hydrostatic pressure against said impact-actuated explosive.

16. The well tool of claim 15 further including:

third means selectively operable only in response to an interim downward movement of a cable coupled to said mandrel following said interim upward cable movement for coupling said mandrel to said anchor actuator before said mandrel is shifted to its said upper position by a final upward cable movement; and fourth means selectively operable only in response to said final upward cable movement following said interim downward cable movement for discharging hydraulic fluid from said second fluid chamber and releasing said piston for further movement in its said second travel span and shifting said anchor members to their said first positions.

17. A method for completing a cased well bore comprising the steps of:

setting a perforating gun having an actuating detonator at a selected depth location in said well bore for positioning said actuating detonator where it is accessible from the surface;

coupling a suspension cable to a wireline tool carrying an impact-actuated explosive charge and including a selectively-releasable pressure-responsive actuator cooperatively arranged in the body of said wireline tool for successive movements therein in a first travel span without restraint and in a second travel span, extendible tool-anchoring means coupled to said actuator and detonating means including a selectively-releasable firing pin coupled to said actuator;

lowering said suspension cable and wireline tool into said well bore for stationing said wireline tool therein where said impact-actuated explosive charge is in detonating proximity of said actuating detonator on said perforating gun;

moving said suspension cable downwardly for releasing said pressure-responsive actuator for movement in its said first travel span to extend said tool-anchor means; and moving said suspension cable upwardly for releasing said pressure-responsive actuator for movement in its said second travel span to release said firing pin for striking said impact-actuated explosive charge to set off said actuating detonator on said perforating gun.

18. A method for completing a cased well bore comprising the steps of:

lowering a perforating gun having an explosively-actuated detonator to a location in said well bore where said explosively-actuated detonator is accessible from the surface;

coupling a suspension cable to a wireline tool including a piston actuator responsive to well bore pressures and initially releasable for unretarded rapid movement in a first travel span and subsequently releasable for retarded slower movement in a second travel span, a tool anchor extendible in response to the movement of said piston actuator in its said first travel span, an impact-actuated explosive charge, and a firing pin operable in response to the movement of said piston actuator in its said second travel span for striking said impact-actuated explosive charge;

lowering said suspension cable and wireline tool into said well bore for positioning said impact-actuated explosive charge in detonating proximity of said explosively-actuated detonator on said perforating gun;

after said explosive charge is positioned in detonating proximity of said detonator, slacking off said suspension cable for releasing said piston actuator for unretarded movement in its said first travel span to rapidly extend said tool anchor into anchoring engagement in said well bore; and after said tool anchor is extended, applying tension to said suspension cable for releasing said piston actuator for retarded movement in its said second travel span to ultimately free said firing pin for striking said impact-actuated explosive charge and setting off said actuating detonator on said perforating gun.

19. A method for completing a cased well bore comprising the steps of:

lowering a perforating gun having an explosively-actuated detonator to a location in said well bore where said explosively-actuated detonator is accessible from the surface;

coupling a suspension cable to a wireline tool including a pressure-actuated tool anchor responsive to well bore pressures and immediately releasable in response to a downward movement of said suspension cable, an impact-actuated explosive charge, and a pressure-actuated firing pin responsive to well bore pressures and subsequently releasable after a predetermined delay in response to an upward movement of said suspension cable;

lowering said suspension cable and wireline tool into said well bore for positioning said impact-actuated explosive charge in detonating proximity of said explosively-actuated detonator on said perforating gun;

after said explosive charge is positioned in detonating proximity of said detonator, slacking off said suspension cable for immediately releasing said tool anchor to move rapidly into anchoring engagement in said well bore; and after said tool anchor is extended, applying tension to said suspension cable for subsequently releasing said firing pin after a predetermined delay to strike said impact-actuated explosive charge and set off said actuating detonator on said perforating gun.

20. The method of claim 19 further including the subsequent step of applying tension to said suspension cable once said actuating detonator is set off for retracting said tool anchor.

21. A method of anchoring a well tool to a wall of a wellbore when said well tool suspends from a cable in said wellbore, detonating an explosive in said well tool, and removing the anchor, comprising the steps of:

(a) moving said cable in first longitudinal direction when said well tool suspends from said cable in said wellbore;

(b) anchoring said well tool to the wall of said wellbore in response to the moving step (a);

(c) following the anchoring step (b), moving said cable in a second longitudinal direction which is opposite to said first longitudinal direction, said cable moving from a first point to a second point, a predetermined time elapsing during movement of said cable from said first point to said second point; and (d) detonating said explosive in said well tool when said cable reaches said second point.

22. The method of claim 21, further comprising the steps of:

(e) moving said cable in said first longitudinal direction, said cable moving from said second point to a third point;

(f) when said cable reaches said third point, moving said cable in said second longitudinal direction; and (g) during the moving step (f), un-setting the anchor of said well tool to said wall of said wellbore.

23. Apparatus for anchoring a well tool which suspends from a cable in a wellbore to a wall of said wellbore, detonating an explosive in said well tool, and removing the anchor, comprising:

first means responsive to a movement of said cable in a first longitudinal direction in said wellbore for anchoring said well tool to said wall of said wellbore;

second means responsive to a movement of said cable in a second longitudinal direction in said wellbore which is opposite to said first longitudinal direction for detonating said explosive; and third means responsive to successive subsequent movements of said cable in the first and second longitudinal directions for unsetting the anchor of said well tool from said wall of said wellbore.

24. The apparatus of claim 23, wherein said second means detonates said explosive in response to a movement of said cable from a first point to a second point in said second longitudinal direction, a predetermined time period elapsing during movement of said cable from said first point to said second point, said explosive detonating when said cable reaches said second point.

25. The apparatus of claim 23, wherein said third means retrieves the anchor during the subsequent movement of said cable in said first longitudinal direction and un-sets the anchor during the subsequent movement of said cable in said second longitudinal direction.

* * * * *